US005311200A

United States Patent [19]

Walker et al.

[11] Patent Number: 5,311,200

[45] Date of Patent: May 10, 1994

[54] MILLIMETER WAVE VARIABLE WIDTH WAVEGUIDE SCANNER

[75] Inventors: Joel F. Walker, Malibu; Daniel G. Gonzalez, Topanga; Gerald E. Pollon, Calabasas, all of Calif.

[73] Assignee: Malibu Research Associates, Inc., Calabasas, Calif.

[21] Appl. No.: 88,410

[22] Filed: Jul. 7, 1993

Related U.S. Application Data

[63] Continuation of Ser. No. 716,677, Jun. 18, 1991, abandoned.

[51] Int. Cl.[5] ..... H01Q 13/10

[52] U.S. Cl. ..... 343/771; 343/770; 333/248

[58] Field of Search ..... 343/754, 770, 771, 758, 343/762; 333/248, 239; H01Q 13/00, 13/10

[56] References Cited

U.S. PATENT DOCUMENTS

| | | | |
|---|---|---|---|
| 3,004,259 | 10/1961 | Shanks et al. | 343/771 |
| 3,740,751 | 6/1973 | Nemit | 343/771 |
| 3,829,862 | 8/1974 | Young | 343/767 |
| 4,164,742 | 8/1979 | Nemit | 343/768 |
| 4,229,745 | 10/1980 | Krieger | 343/771 |
| 4,330,784 | 5/1982 | Ryno et al. | 343/771 |
| 4,516,131 | 5/1985 | Bayha et al. | 343/770 |
| 4,752,781 | 6/1988 | Wood | 343/771 |

FOREIGN PATENT DOCUMENTS

| | | | |
|---|---|---|---|
| 0156201 | 9/1983 | Japan | 343/770 |
| 0180205 | 9/1985 | Japan | 343/767 |
| 0602689 | 6/1968 | United Kingdom | 343/771 |
| 2142476 | 1/1985 | United Kingdom | 343/767 |
| 2170959 | 8/1986 | United Kingdom | 343/767 |

OTHER PUBLICATIONS

R. M. Robertson, "Airborne Scanners", *Radar Scanners and Randomes*, pp. 185 through 193 (1948) no month.

R. M. Roberston, "Variable Width Waveguide Scanners for Eagle and GCA", *Radiation Laboratory Report No 840*, (Apr. 30, 1946).

*Primary Examiner*—Donald Hajec
*Assistant Examiner*—Tan Ho
*Attorney, Agent, or Firm*—Hoffmann & Baron

[57] ABSTRACT

A variable width waveguide scanner includes a pair of spaced apart waveguides defined by U-shaped sleeves each having an open end. A U-shaped plunger having spaced apart parallel first and second arms is coupled to the waveguides such that the arms are received by the open ends of the sleeves and are reciprocatingly slidable in the sleeves. A plurality of radiating elements in the form of spaced apart slots are formed in an end wall of each waveguide.

16 Claims, 6 Drawing Sheets

MILLIMETER WAVE VARIABLE WIDTH WAVEGUIDE SCANNER

CROSS REFERENCE TO RELATED APPLICATIONS

This is a file wrapper continuation application of copending application Ser. No. 07/716,677 filed on Jun. 18, 1991, now abandoned.

BACKGROUND OF THE INVENTION

1. Field of the Invention

The present invention relates to beam scanning antennas, and more specifically relates to waveguide scanners. Even more particularly, the present invention relates to variable width waveguide scanners.

2. Description of the Prior Art

Variable width waveguide scanning antennas are well known in the art. They were first developed during World War II and were commonly referred to Eagle scanners. A beam scan of ±30° was achieved with the original Eagle scanners by mechanical variation of the a-dimension of an end-fed waveguide from which microwave energy was coupled using probes to a series of radiating dipoles. The Eagle scanner was based on the principle that variation of the waveguide a-dimension caused a variation of velocity of propagation within the waveguide. This change in waveguide velocity resulted in a corresponding change in the element-to-element phase shift which "scanned" the beam.

The Eagle scanner described above was composed of two principal elements, as shown in FIG. 1. The first element is a movable "waveguide squeeze" section which produced the variation in the microwave propagation within the waveguide. This section employed two nested L-shaped sections 2 which were moved relative to each other (in the direction of the arrows) to reduce the effective a-dimension of the waveguide structure formed between them. Waveguide chokes in the form of quarter wave slots 4 were formed in the smaller leg portion 6 of each L-section to reduce leakage of microwave energy through the gaps between the two L-sections.

The second principal element of the basic Eagle scanner was the structure which was employed to couple energy from the waveguide squeeze section out to form the desired scanning beam. A row of waveguide probes 8 were employed for this purpose. The probes 8 were mounted in the larger leg portion 10 of one of the L-sections defining the broad wall of the waveguide and extend into the waveguide squeeze section, i.e., into the waveguide cavity. Each probe was terminated in a dipole radiator (not shown) which acted in conjunction with the other dipole radiators to form the microwave beam. The Eagle scanning technique has been described in the following references, the disclosures of which are incorporated herein by reference: MIT Radiation Laboratory Series, Book 26- "Radar Scanners and Radomes", McGraw-Hill, 1948; L. W. Alverez, "Microwave Linear Radiators", Radiation Laboratory Report No. 366, Jul. 31, 1942; and R. M. Robertson, "Variable Width Waveguide Scanners for Eagle and GCA", Radiation Laboratory Report No. 840, Apr. 30, 1946.

A fundamental problem with the waveguide squeeze technique and, in particular, the Eagle scanner described above is the variation in the amount of coupling to the waveguide probes as the a-dimension is changed. In the Eagle scanner described above, the effective coupling may vary by a factor of 10:1 as the a-dimension is changed for a practical range of operating values. This results in poor scanning performance.

Second, the probe coupling technique used on the Eagle scanner is not practical at millimeter wave frequencies because of the precision required to manufacture, install and adjust the individual probes.

OBJECTS AND SUMMARY OF THE INVENTION

It is an object of the present invention to provide a variable width waveguide scanner operable at high microwave and millimeter wave frequencies.

It is another object of the present invention to provide a variable width waveguide scanner capable of being coupled endwise to another scanner to achieve larger apertures and of being fed bi-directionally to achieve an increased scan coverage.

It is yet a further object of the present invention to provide a millimeter wave or microwave variable width waveguide scanner which exhibits a minimal variation in coupling to the radiating elements as the a-dimension is changed.

It is yet another object of the present invention to provide a variable width waveguide scanner which attains good sidelobe performance when fed from either end.

It is still another object of the present invention to provide a variable width waveguide scanner employing slot radiators situated in two parallel rows in an edge wall of the scanner.

It is still another object of the present invention to provide a variable width waveguide scanner which overcomes the inherent disadvantages of the Eagle scanner described previously.

In accordance with one form of the present invention, a variable width waveguide scanner operable for millimeter frequencies basically includes structure which defines at least one signal propagation waveguide. The propagation waveguide has an end wall and defines a waveguide cavity. The cavity is rectangular in cross-section and is defined with an a-dimension, and a b-dimension in a direction perpendicular to the a-dimension and in a direction parallel with the end wall. The waveguide defining structure may be in the form of a U-shaped sleeve having an open end disposed opposite to the end wall.

The variable width waveguide scanner further includes structure for varying the a-dimension of the waveguide cavity. Such structure may be in the form of a rectangular plunger which is received by the open end of the U-shaped sleeve and which is reciprocatingly slidable therein in a direction towards and away from the waveguide end wall.

The waveguide scanner further includes a plurality of radiating elements. The radiating elements are in the form of spaced apart slots formed through the thickness of the end wall of the waveguide and communicating with the waveguide cavity. The scanner may further include a pair of chokes in the form of quarter wave slots formed in the rectangular plunger.

As the plunger moves in and out of the sleeve defining the propagation waveguide, the a-dimension of the waveguide cavity will vary and the velocity of the electromagnetic energy traveling through the waveguide will accordingly change, thereby causing the angle of the wave front of the signal transmitted by the radiating slots to vary.

These and other objects, features and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
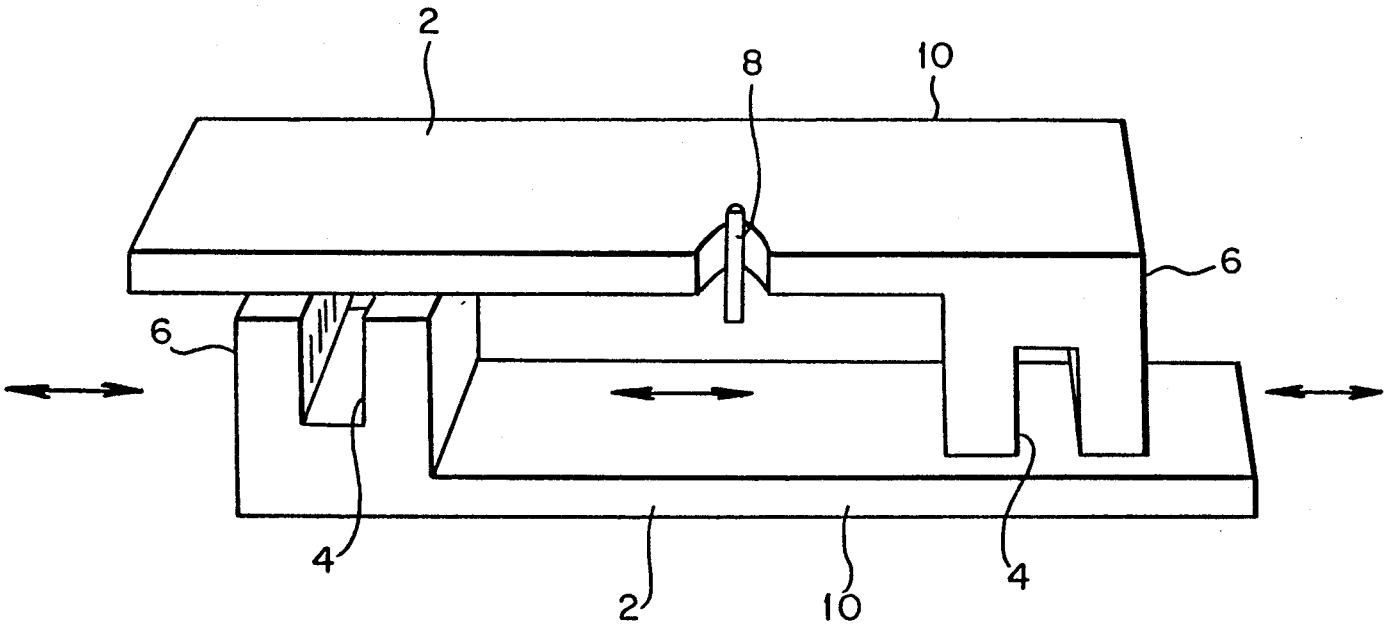
FIG. 1 (PRIOR ART)
FIG. 1 is a perspective view of a cross-sectional segment of a simplified form of a conventional Eagle scanner.
Figure 2:
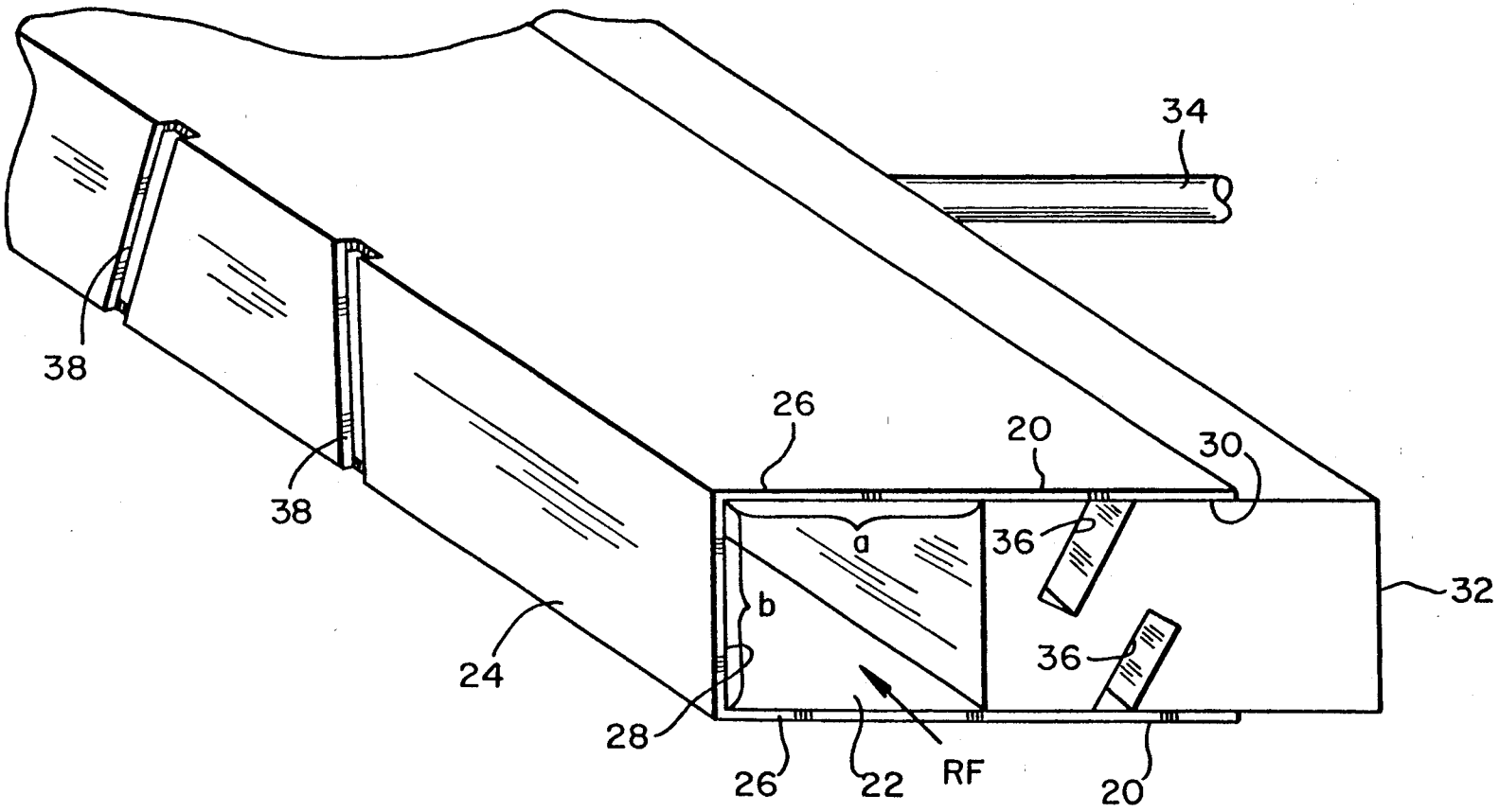
FIG. 2 is a perspective view of a variable width waveguide scanner formed in accordance with one form of the present invention.

Initially referring to FIG. 2 of the drawings, it will be seen that a variable width waveguide scanner formed in accordance with the present invention in its most basic form includes a U-shaped sleeve 20 which defines a signal propagation waveguide 22. The signal propagation waveguide 22 has an end wall 24, and is defined by the sleeve with opposite broad walls 26 adjoining the end wall 24. The sleeve 20 defines the waveguide with a waveguide cavity 28 which is rectangular in cross-sectional shape. The cavity is defined with an a-dimension, which corresponds to the length of the broad wall 26 of the waveguide defined by the sleeve, and a b-dimension, which corresponds to the length of the end wall 24 of the waveguide measured in a direction perpendicular to the a-dimension and parallel with the end wall. The U-shaped sleeve 20 which defines the waveguide includes an open end 30 disposed opposite to the end wall 24 of the waveguide.

The variable width waveguide scanner further includes a rectangular plunger 32 formed as an elongated solid bar member. The plunger 32 is dimensioned such that it is receivable by the open end 30 of the U-shaped sleeve and is reciprocatingly slidable in the sleeve 20 in a direction towards and away from the waveguide end wall 24. The plunger 32 is moved in and out of the sleeve by using a linear actuator or the like (not shown), which includes a drive shaft 34 coupled to the rectangular plunger.

As the plunger 32 moves in the sleeve, the a-dimension of the waveguide cavity changes. In accordance with well-known principles, the velocity of the traveling wave in the waveguide changes proportionally to the change in the a-dimension.

The variable width waveguide scanner may further include chokes. Preferably, these chokes are in the form of quarter wave slots 36 which are formed in the rectangular plunger 32. The quarter wave chokes shown in FIG. 2 are formed at an angle in opposite surfaces of the rectangular plunger and offset from one another so that the proper length slot may be formed without the slots interfering with one another in the plunger which is relatively small in thickness.

The variable width waveguide scanner also includes a plurality of radiating elements. The radiating elements are in the form of spaced apart slots 38 formed through the thickness of the end wall 24 of the waveguide and communicating with the waveguide cavity 28. The slots 38 preferably have a particular and predetermined spacing, length and orientation with respect to one another, as will be described in greater detail.

Figure 3:
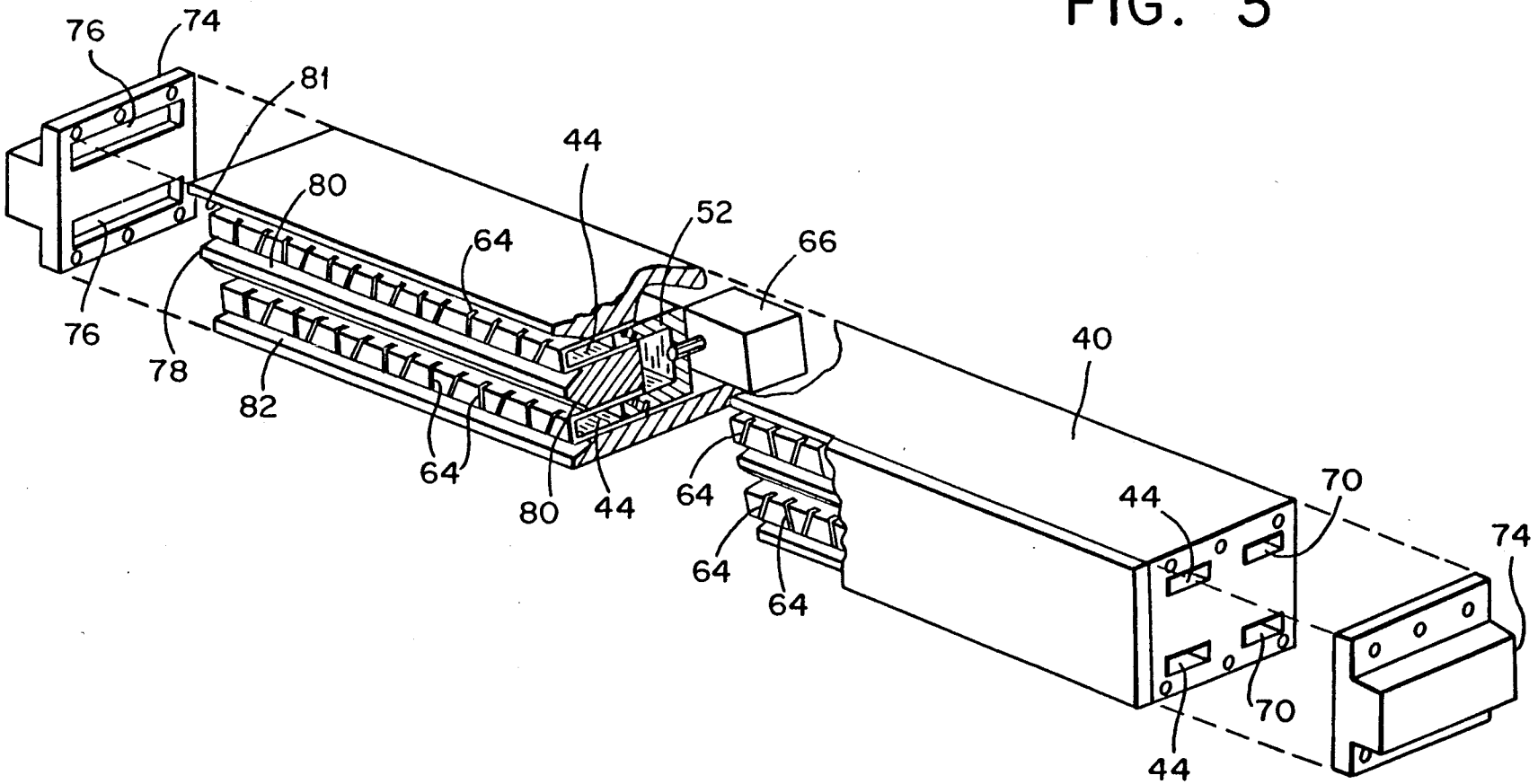
FIG. 3 is an exploded, partially broken perspective view of a variable width waveguide scanner formed in accordance with a second form of the present invention.
Figure 3A:
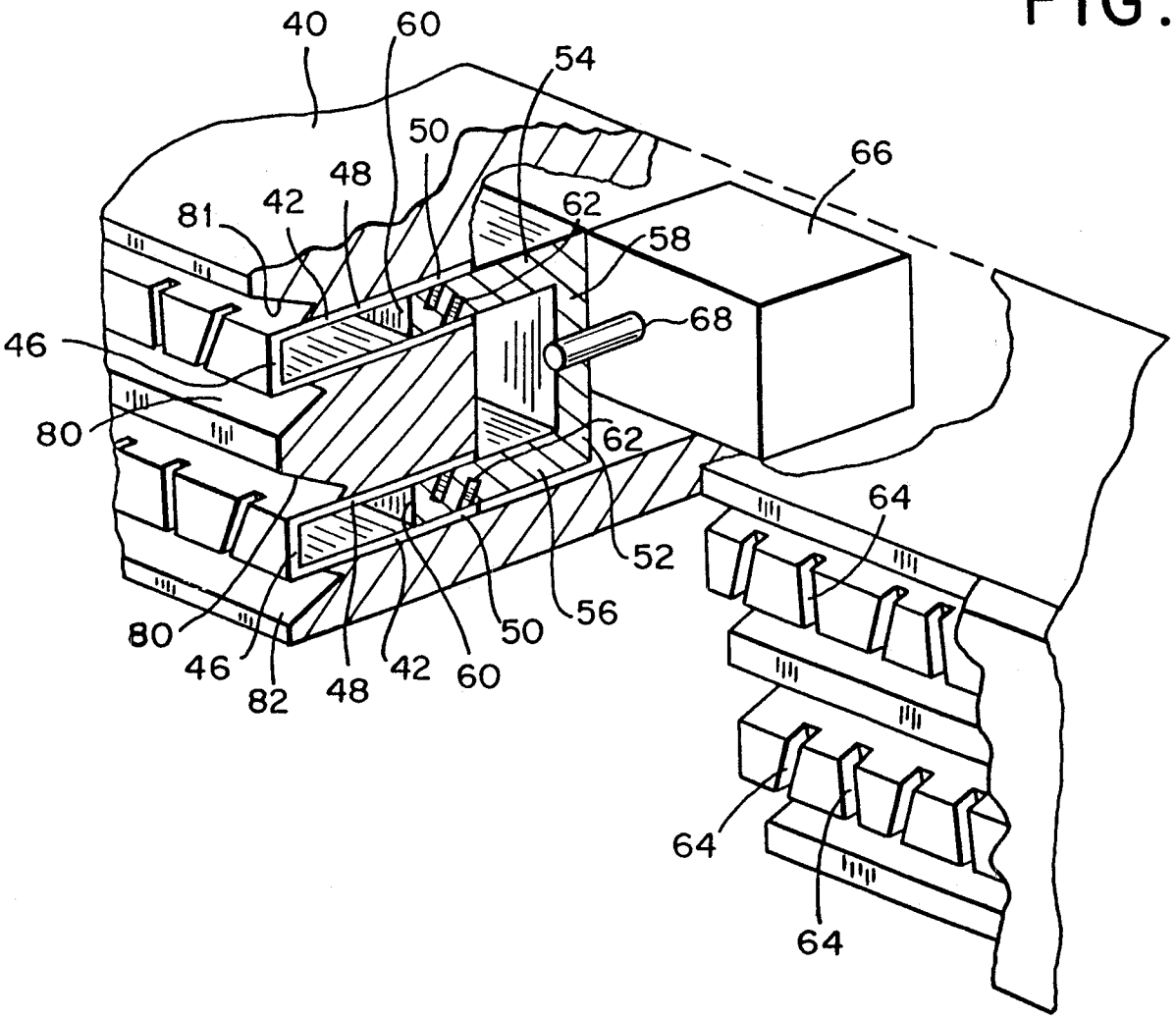
FIG. 3A is an enlarged, partially broken away perspective view of a portion of the scanner shown in FIG. 3.

FIGS. 3 and 3A illustrate a more preferred form of the variable width waveguide scanner formed in accordance with the present invention. The scanner includes an elongated housing 40, and a pair of spaced apart U-shaped sleeves 42 mounted on the housing and thus defining a pair of spaced apart signal propagation waveguides 44. Each propagation waveguide 44 is defined with a first non-movable end wall 46 and opposite broad walls 48 adjoining the end wall. Each waveguide 44 further defines a cavity 50. The cavities 50 are rectangular in cross-section and are defined with an a-dimension along the broad wall 48 and a b-dimension along the end wall 46. Each sleeve 42 which defines a waveguide includes an open end 50 disposed opposite each first non-movable end wall 46.

The waveguide scanner includes a precision U-shaped plunger 52 which is used for varying the a-dimension of each waveguide cavity 50. The U-shaped plunger 52 includes spaced apart parallel first and second arms 54, 56 and a shoulder 58 interconnecting the first and second arms. Each arm 54, 56 is received by the sleeve 42 defining a respective waveguide through the open end and is reciprocatingly slidable in the sleeve in a direction toward and away from the first non-movable end wall 46. Each of the first and second arms 54, 56 has a free end 60 which defines a movable second end wall of a respective waveguide and which is disposed opposite the first non-movable end wall 46. The construction of the U-shaped plunger, with its two arms which are ganged together, allows the a-dimension of each waveguide 44 to be controlled in unison.

As with the previous embodiment, the variable width waveguide scanner shown in FIG. 3 may include chokes to minimize microwave leakage from the gap between the U-shaped plunger arms 54, 56 and the sleeves defining the waveguides. The chokes are preferably in the form of quarter wave slots 62 which are formed in the first and second arms 54, 56 of the U-shaped plunger in the same manner as described previously with respect to the embodiment of FIG. 2.

The variable width waveguide scanner further includes a plurality of radiating elements. The radiating elements are in the form of spaced apart slots 64 formed in the first non-movable end walls 46 of the propagation waveguides 44. The slots communicate with the respective cavities of the waveguides in which they are formed. The scanner may also include a polarizer and/or radome 65 mounted on the housing in front of the radiating slots 64.

The scanner further includes a linear actuator which provides reciprocating sliding movement of the U-shaped plunger 52. The linear actuator may be in the form of one or more high speed voice coil actuators 66 mounted on the housing and having a movable drive shaft 68 mounted thereon and secured to the shoulder 58 of the U-shaped plunger.

In another preferred form of the invention, the variable width waveguide scanner may include a pair of spaced apart signal feed waveguides 70. Each of the signal feed waveguides 70 defines a waveguide cavity 72, and is mounted on the housing 40 and extends along the length thereof in a direction parallel to the propagation waveguides. The propagation waveguides 44 and the feed waveguides 70 extend entirely along the housing to the opposite lateral ends of the scanner housing.

A removable end cap 74 may be mounted on each lateral end of the scanner housing. Each end cap 74 has formed in one of its surfaces which faces a corresponding housing lateral end a pair of channels 76. Each respective channel 76 is in communication with the cavity 50 of one of the pair of propagation waveguides and the cavity 72 of one of the pair of feed waveguides. This is to allow microwave energy traveling through the feed waveguide to be coupled to the propagation waveguide.

The variable width waveguide scanner preferably also includes an elongated solid block member 76 disposed between the first and second arms 54, 56 of the U-shaped plunger. The elongated member includes an exposed surface 78 which is disposed proximately to the radiating slots 64 formed in the end walls of each propagation waveguide 44. The exposed surface 78 includes mutually diverging opposite beveled corners 80 which face the slots formed in the respective signal propagation waveguides 44 and serve to form one side of an elevation flare for each waveguide 44. The elevation flare helps shape the radiated beam. Similar beveled corners 81, 82, acting as elevation flares, may be formed on inside corners of top and bottom portions of the housing and situated in proximity to and facing the radiating slots 64.

The distribution, that is, spacing, disposition angle and size of the radiating slots 64 are chosen to provide a tapered distribution of energy emitted by the scanner. The scanner is, in effect, center weighted so as to provide good sidelobe performance.

More specifically, the angle of each radiating slot 64 is determined by the microwave energy available at the slot along the propagation waveguides 44 and the energy which is desired to be radiated by that particular slot, in order to obtain good sidelobe performance. Since the scanner is designed to be end fed, more RF energy is available at the radiating slots closest to the end of the scanner fed by the input RF signal source. If the slots are more perpendicular to the longitudinal axis of the propagation waveguide, there will be less coupling between the slots and the waveguide, and less RF energy will be radiated. A smaller angle between the radiating slots and the axis of the waveguide will produce greater coupling between the two and more RF energy will be radiated.

Accordingly, to achieve a tapered distribution of RF energy and to suppress the scanner side lobes, the radiating slots are angled or sloped from the vertical (i.e., from a plane normal to the longitudinal axis of the waveguide), and their slope depends on their position on the waveguide. The slots are progressively angled farther from the vertical the closer they are to the center of the scanner and the farther they are from the lateral ends to effect greater coupling, as less energy is available for radiation towards the center of the scanner and to suppress the sidelobes.

Also, adjacent radiating slots of the same waveguide 44 are angled in opposite directions with respect to a plane normal to the waveguide to neutralize a cross-polarization component which is introduced when the radiating slots are disposed at an angle to the axis of the waveguide.

When edge slot radiators are used in conventional slotted waveguides, their design, orientation and size are chosen to allow each slot to be resonant at the frequency of operation. A problem exists, however, in using edge slot radiators in a variable width waveguide scanner in that the effective coupling of the edge slots at resonance varies when the a-dimension of the waveguide is varied. Stated another way, if the waveguide dimension were changed, the impedance of the resonant slots would change and antenna performance would be seriously degraded. For a practical range of operating values for the a-dimension, the coupling of the edge slots may vary by a factor of 10:1, which results in poor scanning performance.

Figure 4:
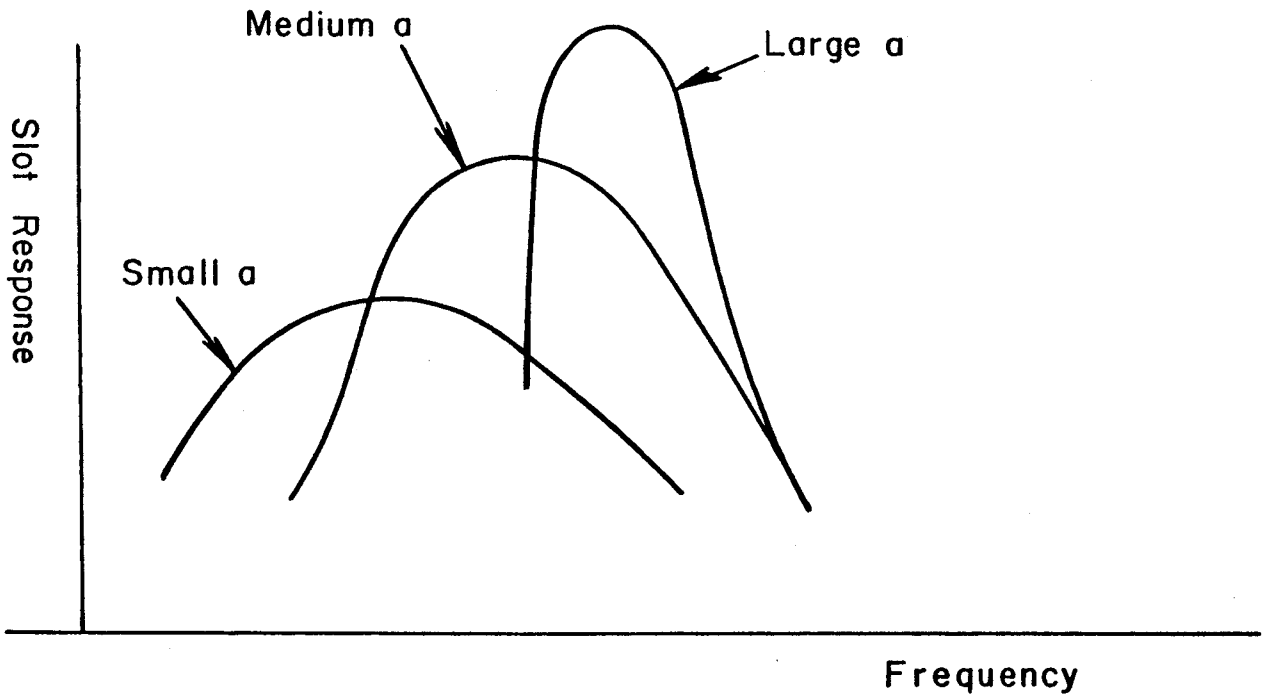
FIG. 4 is a graph of slot response versus frequency of a slotted waveguide and as a function of the a-dimension of the waveguide.

In a preferred form of the present invention, the edge wall slots 64 formed in the propagation waveguides 44 are operated off resonance and, more preferably, at below resonance. The amount of coupling from a slot will be reduced at off resonance frequencies, and that the actual resonance characteristics of a given slot will vary with changes in the waveguide a-dimension, since the waveguide characteristics form a part of the slot resonance circuit. This effect is illustrated by FIG. 4 of the drawings.

The variable width waveguide scanner of the present invention preferably makes use of slot coupling performance at frequencies below resonance. The length of each slot is chosen such that the resultant coupling change with changing a-dimension is compensated for by opposing changes in the off-resonance coupling response of the slots 64. This effect is illustrated by FIG. 5 of the drawings.

Figure 5:
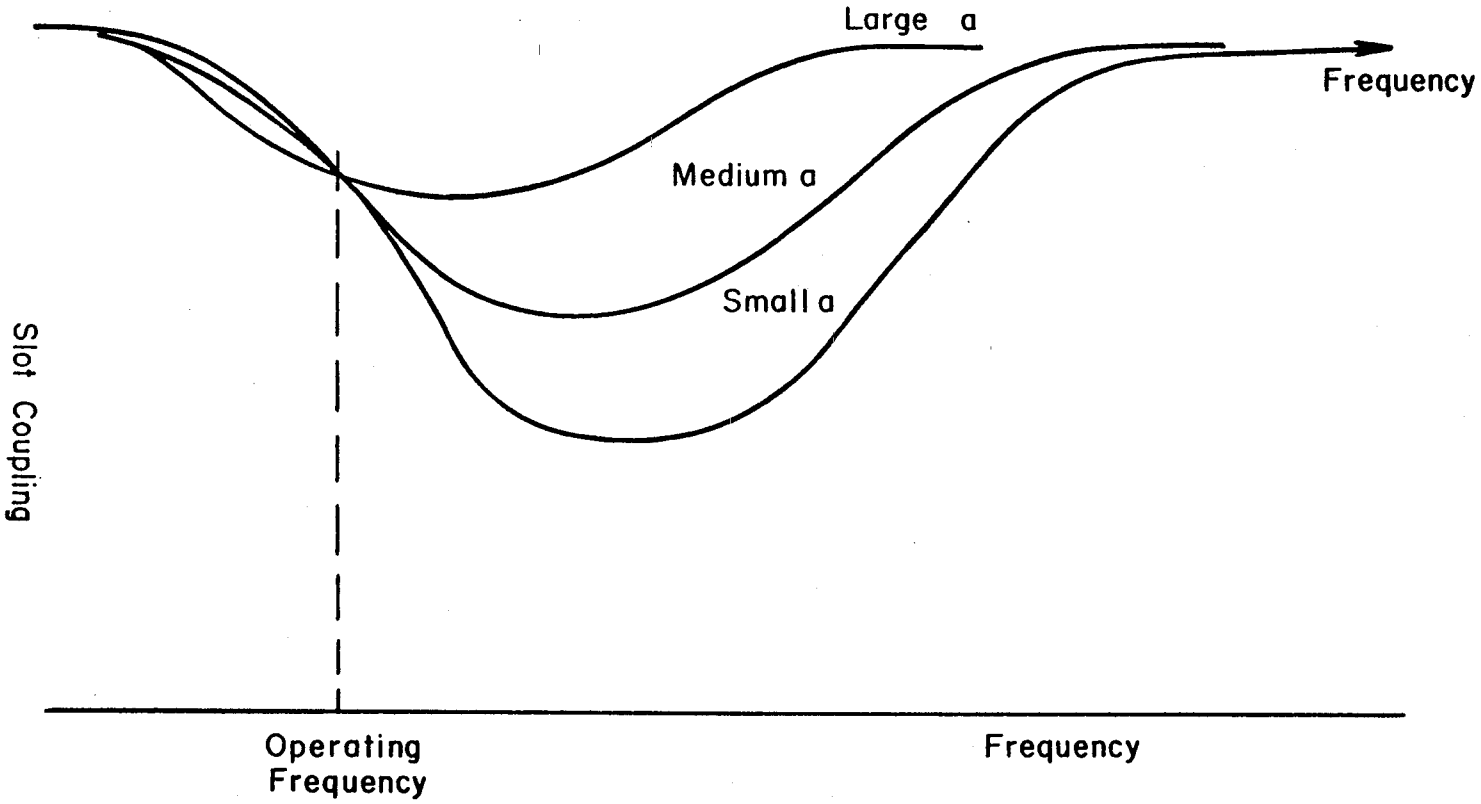
FIG. 5 is a graph of slot coupling versus frequency of a slotted waveguide as a function of the a-dimension of the waveguide.

FIG. 5 shows plots of slot coupling as a function of antenna operating frequency for three typical cases of waveguide a-dimension. It should be noted that there exists a set of slot parameters which exhibit a minimal variation in coupling as the a-dimension is changed. The variable width waveguide scanner of the present invention preferably operates at this point in frequency, which is below the resonant frequency of the slots, to provide the desired coupling compensation when the a-dimension is varied to scan the beam. Thus, by designing the slots to operate off resonance, the slots are maintained at substantially constant impedance over waveguide dimension and/or frequency changes throughout the bandwidth of design.

The variable width waveguide scanner of the present invention is designed to couple with other waveguide scanners. Either end cap 74 may be removed from one of the lateral ends of the scanner housing 40 so that two or more waveguide scanners may be coupled together, end-to-end, by an appropriate end flange or the like (not shown) and so that the propagation waveguides 44 and the feed waveguides 70 of one scanner are coupled to the corresponding waveguides of the next adjacent scanner.

The variable width waveguide scanner of the present invention further is adapted to receive RF energy from either feed waveguide end and still obtain good sidelobe performance from either scan direction, as a result of the combination of optimum slot distribution and coupling, as described previously. A bi-directional feed of RF energy to the scanner may be accomplished by using an appropriate conventional RF switch (not shown) connected to the feed waveguides 70 at the lateral ends of the scanner housing to route the input RF signal to one end or the other to scan in one direction or the other from broad side. The actual angular scan of the radiated beam is provided by the motion of the precision U-shaped plunger 52. The scan angle of the radiated beam is determined by the separation of the slots 64 and width of the propagation waveguide cavity 50 in the a-dimension, which is controlled by the position of the U-shaped plunger 52.

Although illustrative embodiments of the present invention have been described herein with reference to the accompanying drawings, it is to be understood that the invention is not limited to those precise embodiments and that various other changes and modifications may be effected therein by one skilled in the art without departing from the scope or spirit of the invention.

What is claimed is:

1. A variable width waveguide scanner, which comprises:

means defining at least one signal propagation waveguide having an end wall, a first broad wall and a second broad wall opposite the first broad wall defining a waveguide cavity, the waveguide cavity being rectangular in cross-section and defined by an a-dimension in a direction parallel with the first and second broad walls and a b-dimension in a direction perpendicular to the a-dimension and in a direction parallel with the end wall;

means for varying the a-dimension of the waveguide cavity, the a-dimension varying means being operatively coupled to the waveguide, the a-dimension varying means altering the a-dimension of the waveguide cavity in a substantially similar manner along substantially the entire b-dimension of the cavity and along a length of the waveguide; and a plurality of radiating elements, the radiating elements being in the form of spaced apart slots formed through the thickness of the end wall of the waveguide and communicating with the cavity.

2. A variable width waveguide scanner as defined by claim 1, wherein the waveguide defining means includes a U-shaped sleeve having an open end disposed opposite to the end wall; and wherein the a-dimension varying means includes a rectangular plunger, the rectangular plunger being received by the open end of the U-shaped sleeve and being reciprocatingly slidable therein in a direction towards and away from the waveguide end wall.

3. A variable width waveguide scanner as defined by claim 2, which further comprises at least one pair of chokes, the chokes being in the form of quarter wave slots formed in the rectangular plunger.

4. A variable width waveguide scanner as defined by claim 2, which further comprises means for actuating reciprocating sliding movement of the plunger, the plunger movement means being coupled to the plunger.

5. A variable width waveguide scanner as defined by claim 4, wherein the plunger movement means includes at least one voice coil actuator, the actuator including a movable drive shaft mounted thereon and coupled to the plunger.

6. A variable width waveguide scanner as defined by claim 1, which further comprises at least one signal feed waveguide, the feed waveguide defining a cavity and extending parallel to and along the length of the at least one propagation waveguide.

7. A variable width waveguide scanner as defined by claim 6, which further comprises at least one end cap, the end cap having formed therein a channel, the channel being in communication with the feed waveguide cavity and propagation waveguide cavity.

8. A variable width waveguide scanner as defined by claim 1, wherein the slots are dimensioned to operate off resonance to maintain a substantially constant impedance of the slots over variations in the a-dimension of the propagation waveguide cavity.

9. A variable width waveguide scanner, which comprises:

an elongated housing;

means defining a pair of spaced apart signal propagation waveguides mounted on the housing, each propagation waveguide being defined with a first non-movable end wall and defining a waveguide cavity, each cavity being rectangular in cross-section and defined with an a-dimension and a b-dimension in a direction perpendicular to the a-dimension and in a direction parallel with the first end wall of the respective waveguide, the waveguide defining means further defining open ends, each open end being disposed opposite a corresponding first end wall;

means for varying the a-dimension of each waveguide cavity, the a-dimension varying means including a U-shaped plunger having spaced apart parallel first and second arms and a shoulder interconnecting the first and second arms, the first and second arms being received by the open end of the waveguide defining means and being reciprocatingly slidable therein in a direction toward and away from the corresponding first non-movable end wall, each of the first and second arms having a free end defining a movable second end wall of a respective waveguide disposed opposite the first non-movable end wall; and a plurality of radiating elements, the radiating elements being in the form of spaced apart slots formed in the first non-movable end walls of the propagation waveguides and communicating with the respective cavities thereof.

10. A variable width waveguide scanner as defined by claim 9, which further comprises at least two pairs of chokes, the chokes of each pair being in the form of quarter wave slots formed in the first and second arms of the U-shaped plunger.

11. A variable width waveguide scanner as defined by claim 9, which further comprises means for actuating reciprocating sliding movement of the U-shaped plunger, the plunger movement means including a voice coil actuator mounted on the housing and having a movable drive shaft mounted thereon and secured to the shoulder of the U-shaped plunger.

12. A variable width waveguide scanner as defined by claim 9, which further comprises means defining a signal elevation flare, the signal elevation flare defining means including an elongated member disposed between the first and second arms of the U-shaped plunger, the elongated member including an exposed surface disposed proximately to the radiating slots, the exposed surface having mutually diverging opposite beveled corners facing the slots formed in respective signal propagation waveguides.

13. A variable width waveguide scanner as defined by claim 9, which further comprises a pair of spaced apart signal feed waveguides, each of the signal feed waveguide defining a waveguide cavity and being mounted on the housing and extending along the length thereof in a direction parallel to the propagation waveguides.

14. A variable width waveguide scanner as defined by claim 13, wherein the housing has opposite lateral ends and the propagation and feed waveguides extend to the lateral ends of the housing; and wherein the variable width waveguide scanner further comprises at least one end cap, the end cap being mounted on one of the lateral ends of the housing, the end cap having formed therein a pair of channels, each respective channel being in communication with the cavity of one of the pair of propagation waveguides and the cavity of one of the pair of feed waveguides.

15. A method of forming a slotted end wall variable width waveguide scanner, the scanner including a waveguide having a non-movable end wall and first and second broad walls, the second broad wall being opposite to the first broad wall wherein the width of the waveguide measured along the first and second broad walls is selectively altered, means for varying the width of the waveguide, and a plurality of radiating, spaced apart slots formed through the thickness of the end wall of the waveguide, the method comprising the steps of:

dimensioning the slots formed in the end wall of the waveguide to operate off resonance to maintain a substantially constant impedance of the slots over variations in the width of the waveguide.

16. A variable width waveguide scanner which comprises:

means defining at least one signal propagation waveguide having an end wall and defining a waveguide cavity, the cavity being rectangular in cross-section and defined with an a-dimension and a b-dimension in a direction perpendicular to the a-dimension and in a direction parallel with the end wall, the waveguide defining means including a U-shaped sleeve having an open end disposed opposite to the end wall;

means for varying the a-dimension of the waveguide cavity, the a-dimension varying means being operatively coupled to the waveguide, the a-dimension varying means altering the a-dimension of the waveguide cavity in a substantially similar manner along the length of the waveguide, the a-dimension varying means including a rectangular plunger, the rectangular plunger being received by the open end of the U-shaped sleeve and being reciprocatingly slidable therein in a direction toward and away from the waveguide end wall;

a plurality of radiating elements, the radiating elements being in the form of spaced apart slots formed through the thickness of the end wall of the waveguide scanner and communicating with the cavity; and at least one pair of chokes, the chokes being in the form of quarter wave slots formed in the rectangular plunger.

* * * * *